US010758107B2

(12) United States Patent
Park et al.

(10) Patent No.: US 10,758,107 B2
(45) Date of Patent: Sep. 1, 2020

(54) PUMP AND DISHWASHER COMPRISING THE SAME

(71) Applicant: LG ELECTRONICS INC., Seoul (KR)

(72) Inventors: Jinseok Park, Seoul (KR); Kichul Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 218 days.

(21) Appl. No.: 15/917,288

(22) Filed: Mar. 9, 2018

(65) Prior Publication Data

US 2018/0256003 A1 Sep. 13, 2018

(30) Foreign Application Priority Data

Mar. 10, 2017 (KR) ..... 10-2017-0030735

(51) Int. Cl.

| | |
|---|---|
| ***A47L 15/42*** | (2006.01) |
| ***D06F 39/08*** | (2006.01) |
| ***D06F 39/04*** | (2006.01) |
| ***F04D 29/58*** | (2006.01) |
| ***A47L 15/08*** | (2006.01) |

(52) U.S. Cl.

CPC ..... *A47L 15/4291* (2013.01); *A47L 15/08* (2013.01); *A47L 15/4225* (2013.01); *A47L 15/4285* (2013.01); *D06F 39/04* (2013.01); *D06F 39/085* (2013.01); *F04D 29/588* (2013.01); *A47L 2501/06* (2013.01); *A47L 2601/02* (2013.01)

(58) Field of Classification Search

None

See application file for complete search history.

(56) References Cited

U.S. PATENT DOCUMENTS

| | | | | |
|---|---|---|---|---|
| 2006/0054201 | A1* | 3/2006 | Yoon | A47L 15/4285 134/56 D |
| 2010/0108110 | A1* | 5/2010 | Ryu | A47L 15/23 134/184 |
| 2010/0119360 | A1* | 5/2010 | Bredl | F04D 29/426 415/178 |
| 2015/0157185 | A1* | 6/2015 | Welch | A47L 15/4285 134/25.2 |
| 2016/0040686 | A1* | 2/2016 | Li | F04D 29/426 415/177 |
| 2017/0027405 | A1* | 2/2017 | Li | A47L 15/08 |

FOREIGN PATENT DOCUMENTS

| | | | |
|---|---|---|---|
| CN | 103573674 | A | 2/2014 |
| DE | 9411507 | U1 | 10/1994 |
| DE | 4338470 | A1 | 11/1994 |
| DE | 29613481 | U1 | 9/1996 |
| DE | 10224229 | A1 | 12/2003 |
| DE | 202008015058 | U1 | 2/2009 |
| WO | 2017022976 | A1 | 2/2017 |

* cited by examiner

*Primary Examiner* — Cristi J Tate-Sims

(74) *Attorney, Agent, or Firm* — Dentons US LLP

(57) ABSTRACT

The present invention relates to a pump and a dishwasher including the same. The pump of the present invention includes a housing having a cylindrical shape to contain water; an rotatable impeller to discharge the water in the housing to an external; a heater cover to form a bottom surface of the housing; a heater plate joined to a lower side of the heater cover; and a heater joined to a lower side of the heater plate to heat the heater plate. The heater is not in directly contact with the heater cover.

10 Claims, 4 Drawing Sheets

PUMP AND DISHWASHER COMPRISING THE SAME

CROSS-REFERENCE TO RELATED APPLICATION

The present disclosure claims the benefit of priority to Korean Application No. 10-2017-0030735, filed on Mar. 10, 2017, which is herein expressly incorporated by reference in its entirety.

BACKGROUND OF THE INVENTION

1. Field of the Invention

The present invention relates to a pump and a dishwasher including the same, and more particularly, to a pump for heating and conveying washing water and a dishwasher including the same.

2. Description of the Related Art

A dishwasher is a household appliance that removes foreign matter remaining in a tableware by spraying washing water to the tableware. The dishwasher includes a tub for providing a washing space, a rack provided in the tub to accommodate the dishware, a spraying arm for spraying the washing water to the rack, a sump for storing the washing water, and a pump for supplying washing water stored in the sump to the spraying arm.

Meanwhile, the dishwasher washes the tableware by using heated washing water (hot water) or performs cleaning or sterilization of the tableware by supplying steam to the tableware. In a conventional dishwasher, generally, hot water is generated by heating the washing water stored in the sump through a heater provided inside the sump. In this case, since the heater must be exposed to the inside of the sump to contact the washing water, the water level inside the sump must be controlled so that the heater is not exposed to prevent overheating of the heater. In addition, since the heat can be transmitted only when the heater is in contact with the washing water, foreign matter adhered to the surface of the heater may decrease a heat exchange efficiency, and a corroded surface of the heater may deteriorate durability.

To overcome these disadvantages, recently, a dishwasher that installs a heater in a pump has been developed. In this case, the heater contacts a bottom surface of the pump to heat the bottom surface, and the heated bottom surface heats the washing water flowing in the pump. The above problems are overcome as the heater indirectly heats a small amount of washing water temporarily stored in the pump. However, based on a phenomena that the heater intensively heats up a part of the bottom surface or the washing water is collected on a specific part due to a bottom surface structure, lime or other foreign matter contained in the washing water sticks to and piled on the bottom surface of the pump. Accordingly, there is a problem that the heating of the washing water by the heater is not smooth.

SUMMARY OF THE INVENTION

The present invention has been made in view of the above problems, and provides a pump for evenly heating a bottom surface of a pump by a heater and a dishwasher including the pump.

The present invention further provides a pump that prevent a heater from heating a portion of the bottom surface of the pump where the washing water is collected and a dishwasher including the pump.

In accordance with an aspect of the present invention, a pump includes: a housing having a cylindrical shape to contain water; an rotatable impeller to discharge the water in the housing to an external; a heater cover to form a bottom surface of the housing; a heater plate joined to a lower side of the heater cover; and a heater joined to a lower side of the heater plate to heat the heater plate. The heater is not in directly contact with the heater cover.

The heater plate includes: a plate base formed in a circular or circular segment shape; and a plate lip protruding upward from a circumference of the plate base. The heater cover includes: a cover base having a circular shape; a cover holder protruding upward from a circumference of the cover base to form a space in which a part of the heater is accommodated; and a cover rim formed in a circumference of the cover holder and coupled to the housing. The heater includes: a heater body having an arc shape to generate heat; and a terminal to supply power to the heater body. The plate lip is stacked between the cover holder and the heater body.

An external side surface of the heater body is spaced apart from an external side surface of the cover holder.

The plate base is joined to the cover base, and a side surface of the plate lip is joined to an interior side surface of the cover holder and an upper surface of the plate lip is joined to an upper surface of the cover holder.

An upper surface of the heater body is joined to an upper surface of the plate lip and an interior side surface of the heater body is joined to a side surface of the plate lip.

An external side surface of the cover holder is spaced apart from a side surface of the housing.

The pump further includes a heater shield disposed in a lower side of the plate base and the heater body.

In accordance with another aspect of the present invention, a dishwasher includes a tub which accommodates a dishware; a spraying arm which sprays washing water into the tub; a sump which stores the washing water; and a pump which supplies the washing water stored in the sump to the spraying arm, and the pump includes: a housing having a cylindrical shape to contain water; an rotatable impeller to discharge the water in the housing to an external; a heater cover to form a bottom surface of the housing; a heater plate joined to a lower side of the heater cover; and a heater joined to a lower side of the heater plate to heat the heater plate. The heater is not in directly contact with the heater cover.

A part of the heater is formed in an arc shape, the heater cover forms an accommodation space for accommodating a part of the heater plate and a portion of the arc shape of the heater.

An outer circumference of the portion of the arc shape of the heater is spaced apart from a portion of the heater cover forming the accommodation space.

The heater plate is stacked between the heater cover and the heater in the accommodation space.

BRIEF DESCRIPTION OF THE DRAWINGS

The objects, features and advantages of the present invention will be more apparent from the following detailed description in conjunction with the accompanying drawings, in which.

DETAILED DESCRIPTION OF THE PREFERRED EMBODIMENTS

Embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, the present invention will be described with reference to the drawings for explaining a pump and a dishwasher including the same according to embodiments of the present invention.

Figure 1:
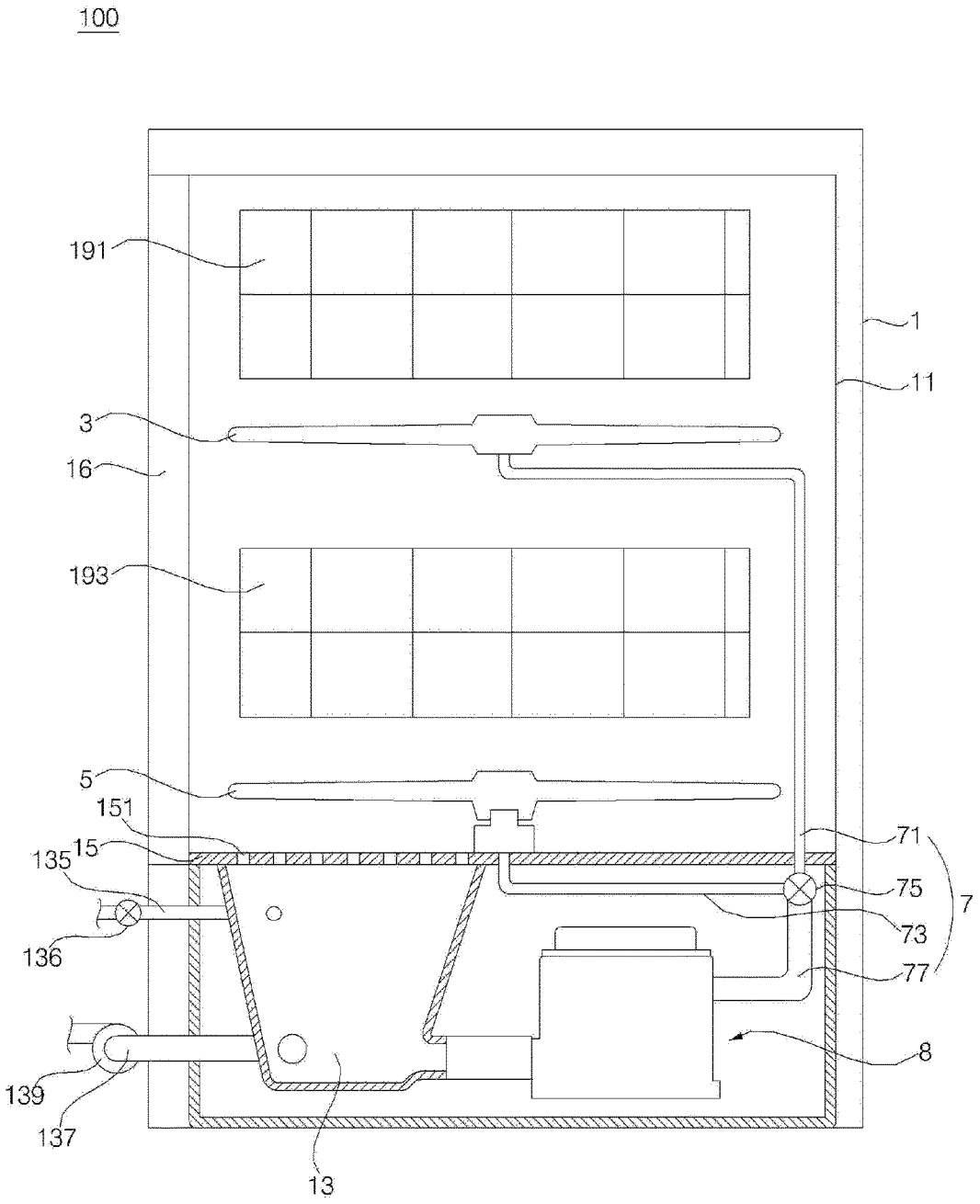
FIG. 1 is a sectional view of a dishwasher according to an embodiment of the present invention.

FIG. 1 is a sectional view of a dishwasher according to an embodiment of the present invention.

A dishwasher 100 according to an embodiment of the present invention may include a cabinet 1 forming an outer appearance, a tub 11 provided inside the cabinet 1 to accommodate a dishware, a plurality of spraying arms 3 and 5 for spraying washing water into the tub 11, a sump 13 for storing washing water, and a pump 8 for supplying the washing water stored in the sump 13 to the plurality of spraying arms 3 and 5.

A plurality of racks 191 and 193 for storing dishware may be provided in the tub 11. The plurality of racks 191 and 193 may include an upper rack 191 provided in the upper area of the tub 11 and a lower rack 193 provided in the lower area of the tub 11.

The tub 11 may be opened and closed by a door 16 provided on one side of the cabinet. A user may take out the plurality of racks 191 and 193 from the tub 11 after opening the door 16.

The plurality of spraying arms 3 and 5 may include an upper arm 3 for spraying washing water to the upper rack 191 and a lower arm 5 for spraying washing water to the lower rack 193. The washing water sprayed from the plurality of spraying arms 3 and 5 may be collected into the sump 13.

The sump 13 may be provided in a lower portion of the tub 11 to store wash water. A sump cover 15 may be disposed in an upper portion of the sump 13. The sump cover 15 may be provided with a recovery hole 151 so that washing water in the tub 11 can pass through the recovery hole 151 and flow into the sump 13.

The sump 13 may be connected to an external water source through a water supply channel 135. The water supply channel 135 may be opened and closed by a water supply valve 136. The washing water stored in the sump 13 may be discharged to the outside of the dishwasher 100 through a drainage path 137 and a drainage pump 139.

The washing water stored in the sump 13 may be supplied to the plurality of spraying arms 3 and 5 through the pump 8 and a supply passage 7. The supply passage 7 may include a connection passage 77 connected to the pump 8, a first supply passage 71 connecting the connection passage 77 and the upper arm 3, and a second supply passage 73 connecting the connection passage 77 and the lower arm 5.

The first supply passage 71 and the second supply passage 73 may be branched from the connection passage 77, and a switching valve 75 for controlling the opening and closing of the first supply passage 71 and the second supply passage 73 may be provided in a branch point of the first supply passage 71 and the second supply passage 73.

The pump 8 may transmit the washing water stored in the sump 13 to the supply passage 7. The pump 8 may heat the washing water transmitted to the supply passage 7. The pump 8 may suck and heat the washing water stored in the sump 13 and supply the heated washing water to the plurality of spraying arms 3 and 5 through the supply passage 7. The pump 8 will be described in detail with reference to FIG. 2.

Figure 2:
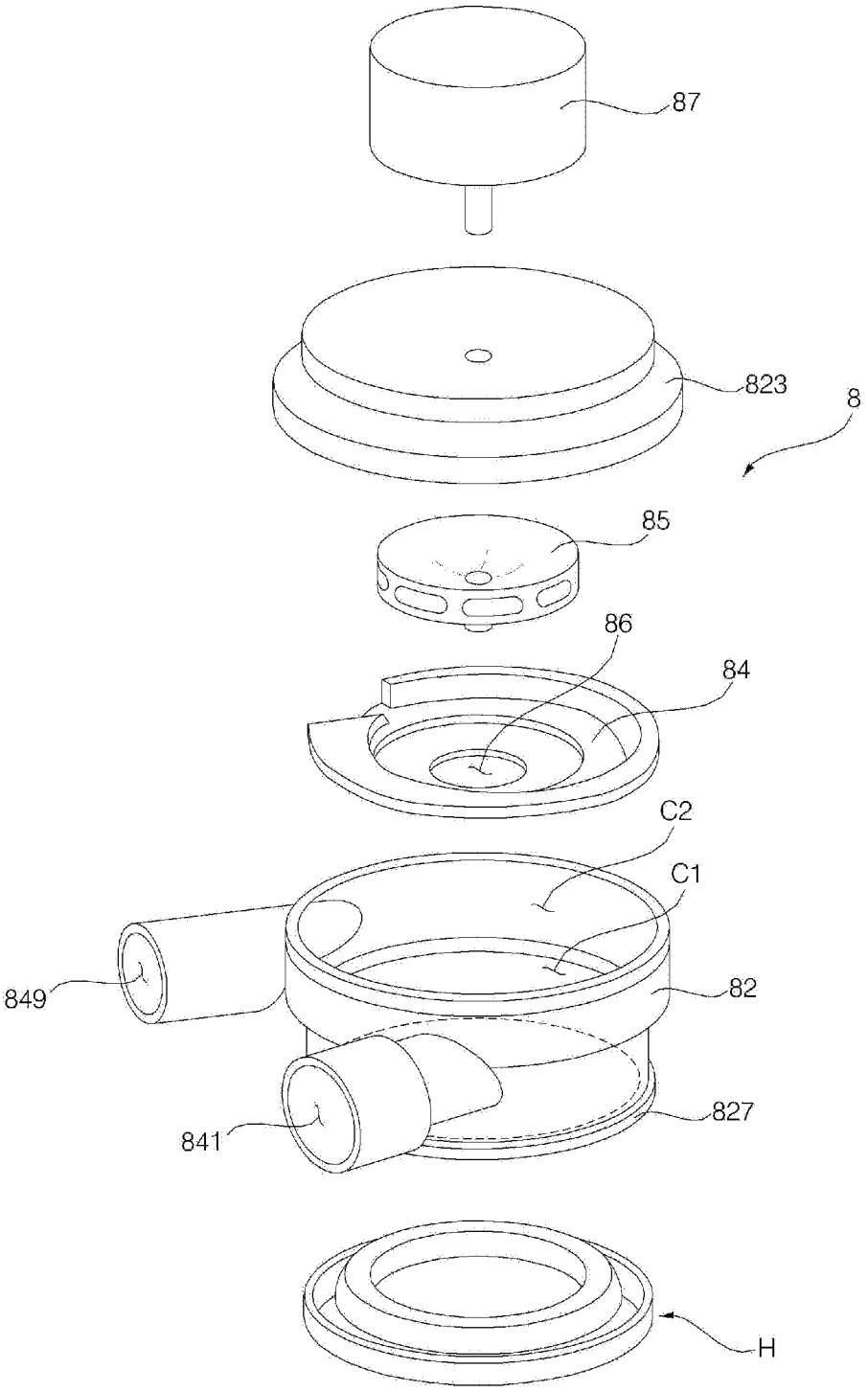
FIG. 2 is an exploded perspective view of a pump according to an embodiment of the present invention.

FIG. 2 is an exploded perspective view of a pump according to an embodiment of the present invention.

The pump 8 according to an embodiment of the present invention may include a housing 82 fixed inside the cabinet 1, a partition wall 84 dividing a space inside the housing 82 into upper and lower spaces and defining a first chamber C1 and a second chamber C2 in the housing 82, a communication hole 86 formed in the partition wall 84 to communicate the first chamber C1 and the second chamber C2, an inlet 841 connecting the sump 13 and the first chamber C1, an outlet 849 connecting the second chamber C2 and the connection passage 77, an impeller 85 provided inside the second chamber, and a heater assembly H provided at the lower end of the housing 82 to heat the washing water.

The housing 82 may be formed in a cylindrical shape having open top and bottom. A housing cover 823 may be coupled to the upper end of the housing 82, and the heater assembly H may be coupled to the lower end. A housing projection 827 protruding in the radial direction may be formed on the lower circumferential surface of the housing 82. The housing cover 823 may cover the upper portion of the housing 82, and the housing cover 823 may be provided with a motor 87 for generating rotation to rotate the impeller 85.

The impeller 85 may discharge the water in the housing 82 to the outside. The impeller 85 may be rotatably disposed in the first chamber C1 of the housing 82. The impeller 85 may rotate to transmit the washing water flowing from the first chamber C1 to the second chamber C2 through the communication hole 86 to the outlet 849. The impeller 85 may be rotated by the motor 87.

The heater assembly H may form the bottom surface of the housing 82 so that the pump 8 simultaneously provides a washing water heating function and a washing water circulation function. A detailed description of the heater assembly H will be given later with reference to FIG. 3 and FIG. 4.

Figure 3:
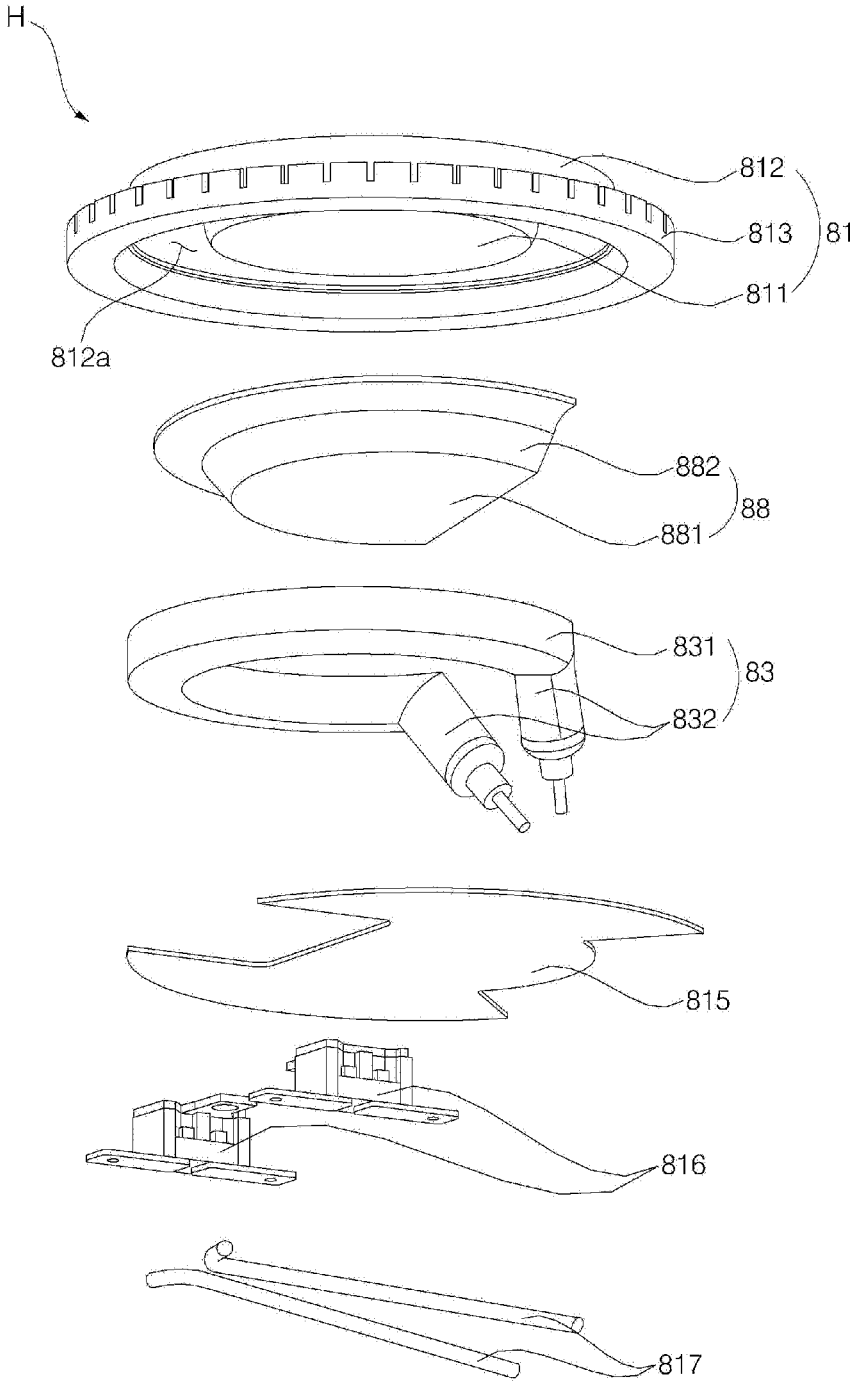
FIG. 3 is an exploded perspective view of a heater assembly of a pump according to an embodiment of the present invention.
Figure 4:
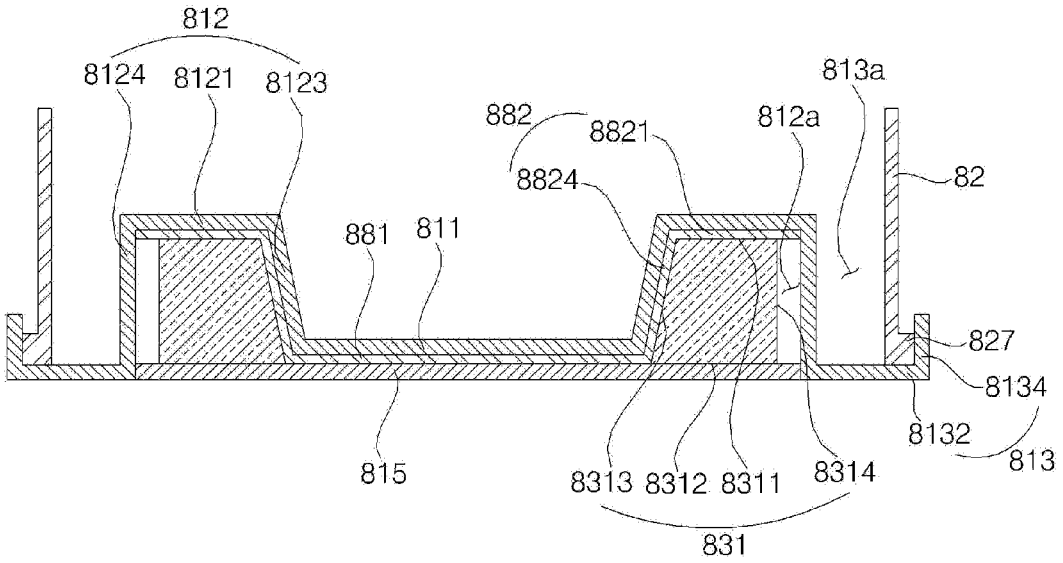
FIG. 4 is a partial vertical cross-sectional view of a pump according to an embodiment of the present invention.

FIG. 3 is an exploded perspective view of a heater assembly of a pump according to an embodiment of the present invention, and FIG. 4 is a partial vertical cross-sectional view of a pump according to an embodiment of the present invention.

The heater assembly H according to the embodiment of the present invention may include a heater cover 81 forming a bottom surface of the housing 82, a heater plate 88 joined to the lower side of the heater cover 81, a heater 83 connected to the lower side of the plate 88 to heat the heater plate 88, a thermostat 816 for supplying power to the heater 83 and controlling the temperature of the heater 83, a wire 817 for electrically connecting the heater 83 and the thermostat 816, and a heater shield 815 for covering a part of the heater 83 from the lower side.

The heater cover 81 is coupled to the lower end of the housing 82 to form the bottom surface of the pump 8. The washing water may flow on the upper side of the heater cover 81. The heater plate 88 may be joined to the lower side of the heater cover 81. The heater cover 81 may be heated by the heater plate 88 to heat the washing water.

The circumference of the heater cover 81 may be formed in a circular shape, and a plurality of upward and downward bends may be formed in a concentric position. The heater cover 81 may include a cover base 811 in the form of a disk, a cover holder 812 protruding upward from the circumference of the cover base 811, and a cover rim 813 formed in the circumference of the cover holder 812 and coupled with the housing 82

The cover base 811 may be formed of a circular plate to form a central portion of the heater cover 81. A plate base 881 of the heater plate 88, which will be described later, may be joined to the lower side of the cover base 811. The cover base 811 and the plate base 881 may be joined by brazing.

The cover holder 812 may be formed in a ring shape protruding upward. The cover holder 812 may form an accommodation space 812*a* in which a part of the heater plate 88 and a part of the heater 83 are accommodated. A plate lip 882 of the heater plate 88 and a heater body 831 of the heater 83, which will be described later, may be accommodated in the accommodation space 812*a* of the cover holder 812. The plate lip 882 may be joined to the lower side of the cover holder 812. The cover holder 812 and the plate lip 882 may be joined by brazing.

The longitudinal section of the cover holder 812 in the radial direction from the center may be formed in an open curve whose lower side is opened. At least a part of the cover holder 812 may correspond to at least a part of the shape of the heater 83 accommodated in the accommodation space 812*a* of the cover holder 812. The cover holder 812 may accommodate a part of the heater 83, but may not be in directly contact with a part of the heater 83 accommodated in the accommodation space 812*a* of the cover holder 812. The outer circumference of the cover holder 812 may be spaced apart from a part of the heater 83 accommodated in the accommodation space 812*a* of the cover holder 812.

In the present embodiment, the cover holder 812 may be formed with three surfaces whose lower side is open. Referring to FIG. 4, the cover holder 812 may include a cover holder interior side surface 8123 which is bent obliquely upward from the cover base 811 to form an interior side surface of the cover holder 812, a cover holder upper surface 8121 which is horizontally bent in the radial direction from the cover holder interior side surface 8123 to form an upper surface of the cover holder 812, and a cover holder external side surface 8124 bent perpendicularly downward from the cover holder upper surface 8121 to form an outer side surface of the cover holder 812.

The cover rim 813 may be formed in a rim shape. The cover rim 813 may be formed to surround the lower end of the housing 82. The circumference edge of the cover rim 813 may protrude upward and may be coupled with the housing 82. Since the cover rim 813 is not in contact with the heater plate 88 and the heater 83, it is heated at a relatively low temperature.

In the present embodiment, the cover rim 813 may be formed in two surfaces, and the longitudinal section in the radial direction from the center may be formed in a "⌋" shape. Referring to FIG. 4, the cover rim 813 may include a cover rim bottom surface 8132 which is bent horizontally in the radial direction from the cover holder external side surface 8124 to form the bottom surface of the cover rim 813, and a cover rim side surface 8134 which is bent vertically upward from the cover rim bottom surface 8132 to form a side surface of the cover rim 813. The upper end of the cover rim side surface 8134 may be curled in the center direction so as to surround the housing projection 827 so that the heater cover 81 is coupled to the housing 82.

The heater plate 88 may be heated by the heater 83 to heat the heater cover 81. The heater plate 88 may be a medium for transmitting the heat of the heater 83 to the heater cover 81. Since the heater 83 may not generate heat evenly, the heater plate 88 may uniformly disperse the heat transmitted from the heater 83 to uniformly heat the heater cover 81.

The circumference of the heater plate 88 may be formed in a circular or circular segment shape and have an edge protruding upward. The heater cover 81 may be joined to the upper side of the heater plate 88 by brazing, and the heater 83 may be joined to the lower side of the heater plate 88 by brazing. The heater plate 88 may be stacked between the heater cover 81 and the heater 83 in the accommodation space 812*a*.

The heater plate 88 may include the plate base 881 whose circumference has a circular or circular segment shape, and the plate lip 882 protruding upward from the plate base 881.

The plate base 881 may be formed in a disk or bow plate shape. On the upper side of the plate base 881, the cover base 811 may be joined by brazing. The heater shield 815 may be disposed in the lower side of the plate base 881.

The plate lip 882 may be formed in a ring or arc shape protruding upward. The plate lip 882 may be inserted into the accommodation space 812*a* of the cover holder 812. The cover holder 812 may be joined to the upper side of the plate lip 882 by brazing, and the heater body 831 of the heater 83 described later may be joined to the lower side of the plate lip 882 by brazing. The plate lip 882 may be stacked between the cover holder 812 and the heater body 831. The plate lip 882 may correspond to a part of the shape of the heater 83 accommodated in the accommodation space 812*a* of the cover holder 812.

In the present embodiment, the plate lip 882 may be formed in two surfaces, and the longitudinal section in the radial direction from the center may be formed in a "⌈" shape. Referring to FIG. 4, the plate lip 882 may include a plate lip side surface 8824 which is bent obliquely upward from the plate base 881 to form a side surface of the plate lip 882, and a plate lip upper surface 8821 which is bent horizontally in the radial direction from the plate lip side surface 8824 to form an upper surface of the plate lip 882.

The plate lip side surface 8824 which is a side surface of the plate lip 882 may be joined, by brazing, to the cover holder interior side surface 8123 which is an interior side surface of the cover holder 812, and the plate lip upper surface 8821 which is an upper surface of the plate lip 882 may be joined, by brazing, to the cover holder upper surface 8121 which is an upper surface of the cover holder 812.

The heater 83 may receive power from the thermostat 816 through the wire 817 to generate heat. The heater 83 may heat the heater plate 88. Since the heater 83 is not directly in contact with the heater cover 81, it may not directly heat the heater cover 81. On the upper side of the heater 83, the heater plate 88 may be joined by brazing. A part of the outer circumference of the heater 83 may be spaced apart from a portion of the heater cover 81 that forms the accommodation space 812*a*.

The heater 83 may include the heater body 831 having an arc shape for generating heat, and a heater terminal 832 for supplying power to the heater body 831.

The heater terminal 832 may receive power from the thermostat 816 through the wire 817 and transmit it to the heater body 831. A plurality of heater terminals 832 may be provided at both ends of the heater body 831. The plurality of heater terminals 832 may extend from both ends of the heater body 831 and be inclined downward. That is, the plurality of heater terminals 832 may protrude downward from a plane formed by the lower end of the heater body 831.

The heater body 831 may be formed in an arc shape whose central angle is larger than 180 degrees. The heater body 831 may include a heating element that generates heat. The heater plate 88 may be joined, by brazing, to the inner and upper sides of the heater body 831. The heater shield 815 may be disposed in the lower side of the heater body 831. The heater body 831 may be inserted into the accommodation space 812*a* of the cover holder 812, but may not be in directly contact with the cover holder 812. The outer circumference of the heater body 831 may be spaced apart from the outer circumference of the cover holder 812.

In the present embodiment, the heater body 831 has a rectangular longitudinal section in the radial direction from the center. Referring to FIG. 4, the heater body 831 may include a heater body upper surface 8311 which is formed horizontally to form an upper surface of the heater body 831, a heater body external side surface 8314 which is formed vertically to form an external side surface of the heater body 831, a heater body interior side surface 8313 which is formed to be inclined to form an interior side surface, and a heater body bottom surface 8312 which is formed horizontally to form a bottom surface of the heater body 831.

The heater body upper surface 8311 which is an upper surface of the heater body 831 may be joined, by brazing, to the plate lip upper surface 8821 which is an upper surface of the plate lip 882. The heater body interior side surface 8313 which is an interior side surface of the heater body 831 may be joined, by brazing, to the plate lip side surface 8824 which is a side surface of the plate lip 882.

The heater body external side surface 8314 which is an external side surface of the heater body 831 may be spaced apart from the cover holder external side surface 8124 which is an external side surface of the cover holder 812. In addition, the cover holder external side surface 8124 which is an external side surface of the cover holder 812 may be spaced apart from the housing 82. Thus, since the cover holder external side surface 8124 is not in contact with the heater plate 88 and the heater 83, it is heated at a relatively low temperature.

Hereinafter, the operation of the pump and the dishwasher including the pump according to the present invention will be described.

When the motor 87 operates to rotate the impeller 85, the washing water stored in the sump 13 may flow into the first chamber C1 inside the housing 82 of the pump 8 through the inlet 841.

In addition, when the thermostat 816 operates to supply power to the heater terminal 832 of the heater 83 via the wire 817, the heater body 831 may generate heat. The heat generated in the heater body 831 may be transmitted to the plate lip upper surface 8821 and plate lip side surface 8824 of the plate lip 882 in contact with the heater body 831. The heat transmitted to the plate lip upper surface 8821 and the plate lip side surface 8824 may be transmitted to the plate base 881 so that the heater plate 88 is evenly heated. The heat of the heater plate 88 may be transmitted to the cover base 811 in contact with the heater plate 88, and the cover holder interior side surface 8123 and cover holder upper surface 8121 of the cover holder 812 so that the cover base 811, and the cover holder interior side surface 8123 and cover holder upper surface 8121 of the cover holder 812 are evenly heated. Thus, the heater cover 81 may heat the washing water accommodated in the first chamber C1 inside the housing 82 of the pump 8.

The washing water heated inside the first chamber C1 may flow into the second chamber C2 through the communication hole 86 by the rotation of the impeller 85 and then flow into the connection passage 77 through the outlet 849. The heated washing water flowing into the connection passage 77 may be sprayed from the upper arm 3 and/or the lower arm 5 through the first supply passage 71 and/or the second supply passage 73 depending on the operation of the switching valve 75. The washing water sprayed from the upper arm 3 and/or the lower arm 5 may be supplied to the tableware housed in the upper rack 191 and/or lower rack 193 to clean the tableware, and may be returned to the sump 13.

Meanwhile, since the cover holder external side surface 8124 of the cover holder 812 and the cover rim 813 are not in contact with the heater plate 88 and the heater 83, they are heated at a relatively low temperature. Thus, the washing water accommodated in the space 813*a* surrounded by the cover holder external side surface 8124, the cover rim bottom surface 8132, and the housing 82 may maintain a relatively low temperature so that the lime of washing water or other foreign matter does not stick to and piled in the space 813*a*.

According to the pump of the present invention and the dishwasher including the same, one or more of the following effects can be obtained.

First, the heater does not directly heat the heater cover forming the bottom surface of the pump but heats the heater plate, so that the heated heater plate uniformly heats the heater cover and concentration of heat generation does not occur in the heater cover.

Second, since the portion where the washing water is collected in the heater cover is not heated, the lime in the washing water or other foreign matter does not stick to the heater cover.

Third, the heater, the heater cover, and the heater plate can be firmly coupled.

Hereinabove, although the present invention has been described with reference to embodiments and the accompanying drawings, the present invention is not limited thereto, but may be variously modified and altered by those skilled in the art to which the present invention pertains without departing from the spirit and scope of the present invention claimed in the following claims.

What is claimed is:

1. A pump comprising:

a housing configured to contain water;

an impeller configured to generate water flow through the housing;

a heater cover forming a bottom surface of the housing;

a heater plate joined to a lower side of the heater cover; and a heater joined to a lower side of the heater plate to heat the heater plate, wherein the heater is not in direct contact with the heater cover, wherein the housing is cylindrically shape opened downwards, and wherein the heater cover comprises:

a cover base having a circular shape;

a cover holder protruding upward from a circumference of the cover base to form a space in which a part of the heater is accommodated; and a cover rim formed in a circumference of the cover holder and coupled to an lower end of the housing.

2. The pump of claim 1, wherein the heater plate comprises:

a plate base formed in a circular or circular segment shape; and a plate lip protruding upward from a circumference of the plate base, wherein the heater comprises:

a heater body having an arc shape to generate heat; and a terminal to supply power to the heater body, wherein the plate lip is stacked between the cover holder and the heater body.

3. The pump of claim 2, wherein an external side surface of the heater body is spaced apart from an external side surface of the cover holder.

4. The pump of claim 2, wherein the plate base is joined to the cover base, and wherein a side surface of the plate lip is joined to an interior side surface of the cover holder and an upper surface of the plate lip is joined to an upper surface of the cover holder.

5. The pump of claim 2, wherein an upper surface of the heater body is joined to an upper surface of the plate lip and an interior side surface of the heater body is joined to a side surface of the plate lip.

6. The pump of claim 2, wherein an external side surface of the cover holder is spaced apart from a side surface of the housing.

7. The pump of claim 2, further comprising:

a heater shield disposed beneath the plate base and the heater body.

8. A dishwasher comprising:

a tub configured to accommodate dishware;

a spraying arm configured to spray washing water into the tub;

a sump configured to store the washing water; and a pump configured to supply the washing water stored in the sump to the spraying arm, wherein the pump comprises:

a housing configured to contain water;

an impeller configured to generate water flow through the housing;

a heater cover forming a bottom surface of the housing;

a heater plate joined to a lower side of the heater cover; and a heater which joined to a lower side of the heater plate to heat the heater plate, wherein the heater is not in direct contact with the heater cover, wherein the housing is cylindrically shape opened downwards, and wherein the heater cover comprises:

a cover base having a circular shape;

a cover holder protruding upward from a circumference of the cover base to form a space in which a part of the heater is accommodated; and a cover rim formed in a circumference of the cover holder and coupled to an lower end of the housing.

9. The dishwasher of claim 8, wherein a part of the heater is formed in an arc shape, wherein the heater cover forms an accommodation space for accommodating a part of the heater plate and a portion of the arc shape of the heater, and wherein an outer circumference of the portion of the arc shape of the heater is spaced apart from a portion of the heater cover forming the accommodation space.

10. The dishwasher of claim 8, wherein the heater cover forms an accommodation space for accommodating a part of the heater plate and a part of the heater, and wherein the heater plate is stacked between the heater cover and the heater in the accommodation space.

* * * * *